US005178274A

United States Patent [19]

Long

[11] Patent Number: 5,178,274

[45] Date of Patent: Jan. 12, 1993

[54] HOLDER-CONTAINER FOR PAINT ROLLER

[76] Inventor: Noal E. Long, 23285 Westwood, Grand Terrace, Calif. 92324

[21] Appl. No.: 792,169

[22] Filed: Nov. 14, 1991

[51] Int. Cl.[5] ..... A45D 44/18; A47L 13/56

[52] U.S. Cl. ..... 206/361; 206/15.3; 220/697; 15/257.06

[58] Field of Search ..... 220/697; 206/361, 15.2, 206/15.3; 15/257.05, 257.06

[56] References Cited

U.S. PATENT DOCUMENTS

| | | | |
|---|---|---|---|
| D. 182,857 | 5/1958 | Showers | D58/17 |
| D. 186,195 | 9/1959 | Cole | D58/17 |
| D. 202,134 | 8/1965 | Bryan | D58/17 |
| D. 212,563 | 10/1968 | Tidwell | D64/18 |
| D. 223,302 | 4/1972 | Golden et al. | D64/18 |
| D. 245,450 | 8/1977 | Donlon | D64/18 |
| D, 293,144 | 12/1987 | Papke | D32/53.1 |
| D. 303,304 | 9/1989 | Sabatino | D32/53.1 |
| 2,698,450 | 1/1955 | Mack | 15/121.1 |
| 2,748,977 | 6/1956 | Sarchet | 220/697 |
| 2,887,705 | 5/1959 | Serwer | 15/121.3 |
| 3,351,970 | 11/1967 | Engh | 15/257 |
| 4,549,562 | 10/1985 | Ossi | 206/15.2 |
| 4,651,379 | 3/1987 | Kern | 15/257.06 |
| 4,771,501 | 9/1988 | Leiter | 220/697 X |
| 4,860,891 | 8/1989 | Biggio | 220/697 X |

*Primary Examiner*—William I. Price

[57] ABSTRACT

A holder-container for paint roller may be utilized in various functions, particularly as a paint roller holder, as a protective enclosure and as a container, having a flat bottom and walls forming a reservoir to receive paint roller, wet paint, water or thinner, which is open at its upper end, opposite to the flat bottom and is provided with a flat snap-on lid (6) which has sufficient height around the perimeter of the lid to extend over the top open end of container (1) which is retained in operative position by suitable means, a groove (5) in container and a raised bead (8) in snap-on lid (6) by applying finger pressure downward on the top surface of snap-on lid (6) causing the raised bead (8) in snap-on lid (6) to pop securely into groove (5) in container (1), like a coffee can lid. Container (1) has a recessed support (2) for paint roller handle to be held in a vertical position, an end support (4) for supporting and holding longer paint roller (9) and post supports (3) for supporting and holding shorter paint roller (9), snap-on lid (6) has a slot (7) to allow paint roller handle (10) to protrude upward through snap-on lid (6), when removing snap-on lid (6) the user places his fingers on the bottom surface of lid with upward pressure causing raised bead (8) in snap-on lid (6) to slide up and out of groove (5) in container (1) causing the snap-on lid (6) to come loose from container (1).

2 Claims, 3 Drawing Sheets

HOLDER-CONTAINER FOR PAINT ROLLER

BACKGROUND

1. Field of Invention

This invention relates to storage of paint rollers, specifically to paint roller holder-containers, providing the user a choice of using the paint roller holder-container as a long term protective paint roller holder-container when the paint roller is not in use and as a paint roller holder-container during interruptions while involved in a painting project.

2. Description of Prior Art

Many, if not most users of paint rollers prefer to store their paint rollers in a container which would hold their paint roller in a ready-to-use condition during the complete time of painting avoiding clean-up of paint roller every time there is an interruption; for example, storage of paint roller overnight, or at lunch break, or moving other items out of the way which could take several hours or transporting the wet paint roller from one place to another. Heretofore, a wide variety of paint pails, paint containers, paint trays, paint containers and covers, paint receptacles, combination paint bucket and tray and paint roller pails have been proposed and implemented for carrying and applying paint to the paint rollers.

One such vertical roller tray is used as a paint receptacle which permits the user to carry the device on his person by means of a shoulder strap or other suitable means, or to support the device from a suitable object but it does not allow the user to store the paint roller overnight because the storage area does not have a cover to keep the paint on the roller from drying out. The user would need to clean up roller if there were any interruptions of long periods of time. For example, one-half hour or longer.

Another type paint pail for a paint roller is made for just dipping the paint roller into the pail to apply the wet paint to the paint roller but does not allow the user to store the paint roller over a long period of time because there is no cover for the paint pail. The user would need to clean up the roller if there were any long periods of interruptions during the painting project.

Another type paint tray is designed to hold the wet paint in the lower area of the tray. The wet paint area is open with no cover. The user would need to clean up the roller if there were interruptions in the painting project which were of long periods; for example, one-half hour or longer.

Another type paint container and cover is designed to hold the wet paint only. There is no consideration for holding the paint roller with the cover in the on position. There is no receptacle in the cover for allowing the paint roller handle to protrude through the cover. Therefore, the paint roller has to be removed from the paint container before the cover is placed on the top of the paint container.

Another type combination paint bucket and tray has a capacity to hold a small quantity of paint at its lower end into which the roller may be dipped and the roller is rolled back and forth on that part of the tray bottom thus distributing the paint over the roller. There is no cover for the bucket or the tray, making it necessary to clean up paint roller if there are any interruptions of any long period of time during the painting project.

Another type paint receptacle allows the user to immerse the roller into the contained paint to absorb a quantity of the paint. The wet paint area of the tray is open and does not have a cover making it necessary for the user to clean up the paint roller when there are long periods of interruptions during the painting project.

Another type paint container allows the user to dip the paint roller into the wet paint container area but the container has no cover making it necessary for the user to clean up the paint roller when there are long periods of interruptions during the painting project.

OBJECTS AND ADVANTAGES

Accordingly, I claim the following as my objects and advantages of the invention: to provide a holder-container for the paint roller while being interrupted while painting; to store the roller overnight—just add water or paint thinner whichever is applicable; holds roller up off the bottom so there are no marks on the roller and all the paint in the roller goes to the bottom of the container (this may be used to thin the paint if needed); may be used to package the paint roller—carry any advertising by the roller manufacture or paint company; will save the expense of roller refills—real economy; can be used to store roller in after being cleaned and is easily installed and not intended to be a water spill-proof fit; two extra support posts hold a shorter roller in the same longer roller container. The paint roller holder-container invention is dramatic. Provides the user with an easy and quick way to store an in-use paint roller, as well as to store an out-of-use paint roller. The snap-on lid is quick to install and remove from the paint roller holder-container. Not needing to clean up the paint roller every time there is an interruption during the painting project is a great convenience and time saver for the user. Readers will find further objects and advantages of the invention from a consideration of the ensuing description and accompanying drawings.

DRAWING FIGURES

DRAWING REFERENCE NUMERALS

1 container 2 recessed support for paint roller handle a molded-in element of 1

3 post supports for shorter paint roller a molded-in element of 1

4 end support for longer paint roller a molded-in element of 1

5 groove for snap-on lid a molded-in element of 1

6 snap-on lid 7 slot for paint roller handle a molded-in element of 6

8 raised bead for snap-on lid a molded-in element of 6

9 paint roller (short or long)

10 paint roller handle

DESCRIPTION OF INVENTION

Figure 1:
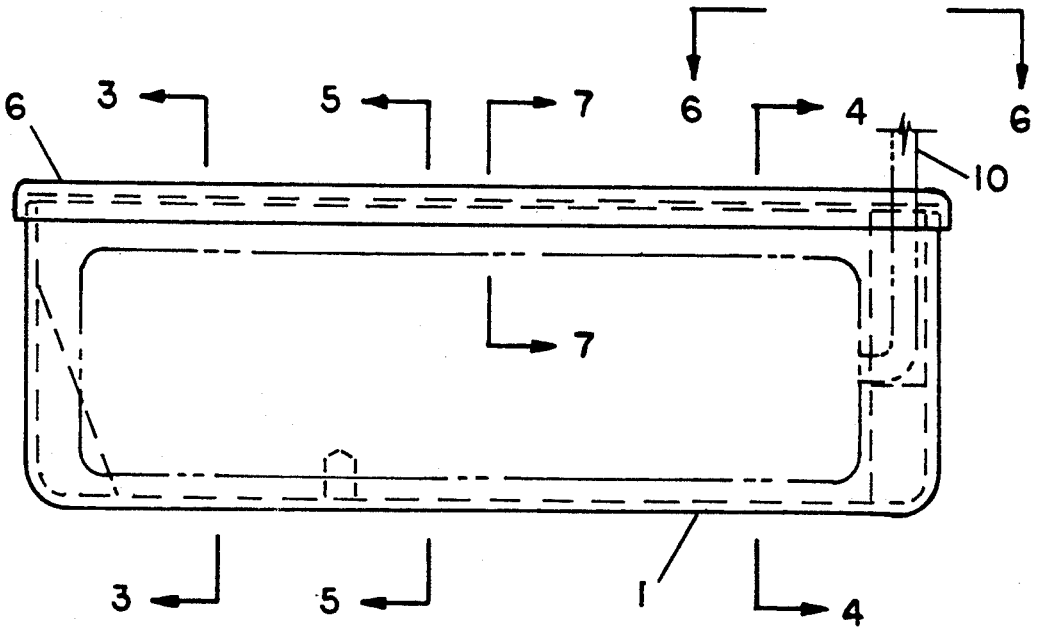
FIG. 1 shows the paint roller holder-container in a front view with paint roller inside the paint roller holder-container with the snap-on lid in the on position.
Figure 6:
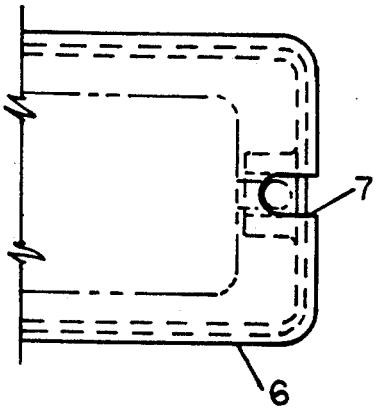
FIG. 6 shows a top view of the snap-on lid with slot to allow paint roller handle to protrude through lid of such paint roller holder-container taken along the line 6—6 FIG. 1.
Figure 7:
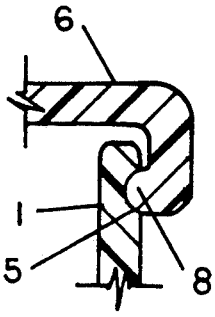
FIG. 7 shows a sectional view of the groove in container and the raised bead of the snap-on lid of such paint roller holder-container taken along the line 7—7 FIG. 1.
Figure 8:
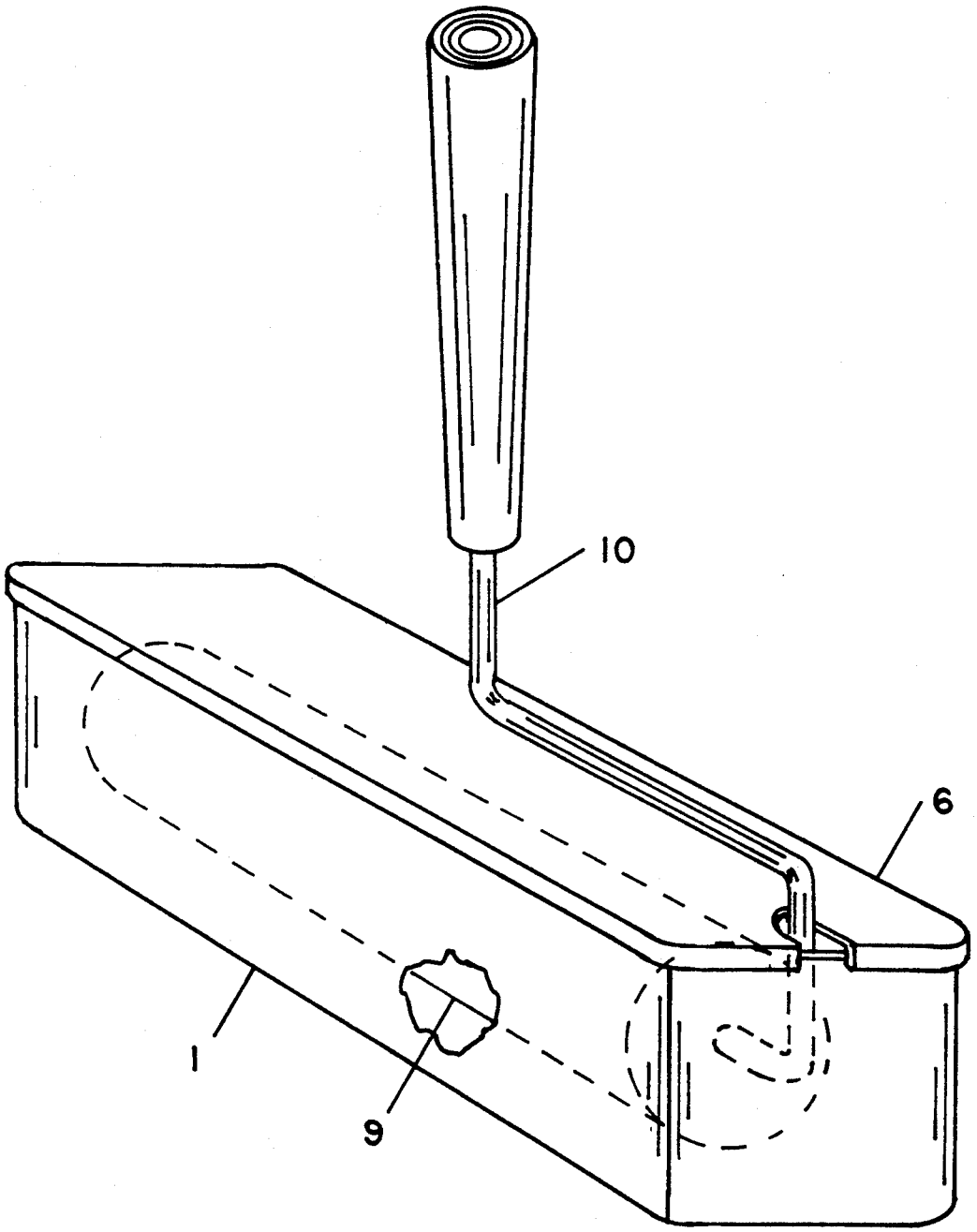
FIG. 8 shows a perspective view of a paint roller holder-container in accordance with the invention.

FIG. 1 front view shows the paint roller holder-container in the closed position. The paint roller holder-container comprises of two parts; a container 1 and a snap-on lid 6. The container 1 comprises of four molded-in elements; recessed support 2, FIG. 2 and FIG. 4, which allows the paint roller handle 10, FIG. 1 and FIG. 4 to be held in an upward position, two post supports 3, FIG. 2 and FIG. 5, for support of the shorter paint roller when used, and support 4, FIG. 2 and FIG. 3, for support of the longer paint roller when used, and groove 5, FIG. 7, for the snap-on lid 6, FIG. 1 and FIG. 7, this groove 5 allows the snap-on lid 6 to firmly snap over the top edge of container 1 in the closed position FIG. 7. The snap-on lid 6 comprises of two molded-in elements; slot 7, FIG. 6, allows the paint roller handle to protrude through the snap-on lid 6 in an upward position, FIG. 1, and raised bead 8, FIG. 7 around the open inside edge of the snap-on lid 6, allowing the snap-on lid 6 to be pressed downward with the users fingers causing raised bead 8, FIG. 7, to pop into groove 5, FIG. 7, causing container 1 to hold firmly snap-on lid 6 in the closed position.

The paint roller holder-container is made of hard durable material, such as injection molded plastic, rubber and/or die cast metal. The paint roller holder-container will vary in size to fit all sizes of paint rollers or one size to fit all sizes of paint rollers.

OPERATION OF INVENTION

Figure 2:
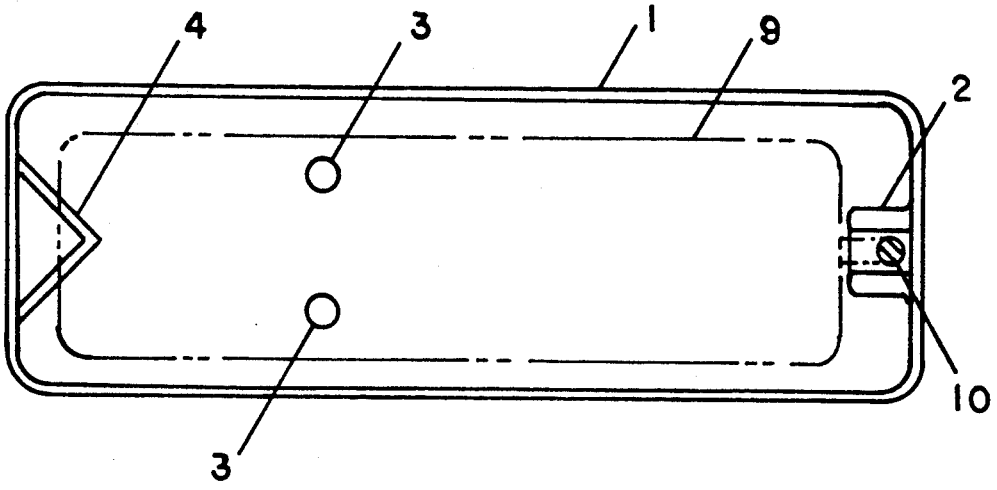
FIG. 2 shows the paint roller holder-container in a top view with snap-on lid removed with paint roller inside the paint roller holder-container.
Figure 3:
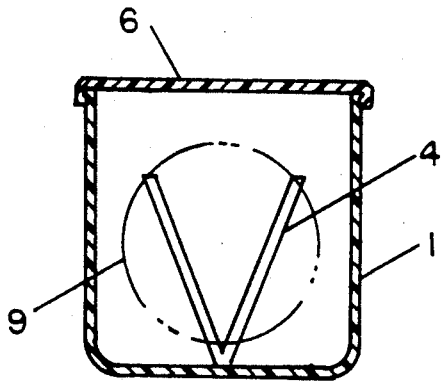
FIG. 3 shows a sectional view of the end support for the longer roller of such paint roller holder-container taken along the line 3—3 FIG. 1.
Figure 4:
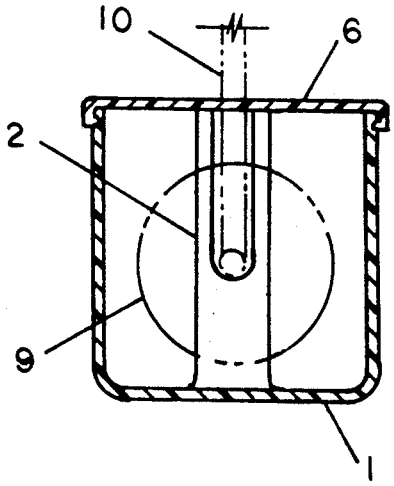
FIG. 4 shows a sectional view of the recessed support of such paint roller holder-container, taken along the line 4—4 FIG. 1.
Figure 5:
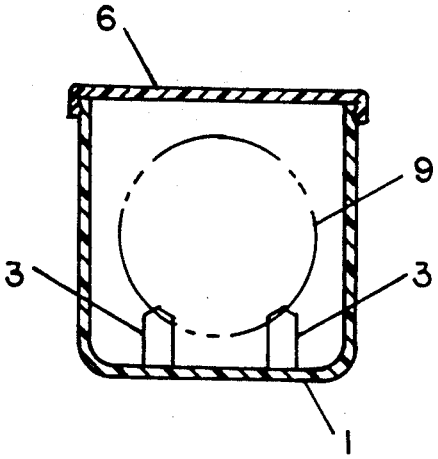
FIG. 5 shows a sectional view of the support posts that support the shorter roller of such paint roller holder-container taken along the line 5—5 FIG. 1.

The paint roller holder-container of FIG. 1 will perform three functions—one as a long term storage container with no wet paint in container 1 with the paint roller placed inside container 1, with the snap-on lid 6 snapped into the closed position over the top edge of container 1, giving the roller complete protection and keeping the roller in a clean environment while the paint roller is not in use for long periods of time or in between painting projects. The second function is a short term storage container with wet paint, water or paint thinner in the container 1 with or without the snap-on lid 6 snapped into the closed position, allowing the user to keep the roller in the wet paint, water or paint thinner supported by the support elements of container 1. The third function is a holder for the paint roller 9, FIG. 1 and FIG. 2, to hold the paint roller up off the bottom of container 1 and a holder for the paint roller handle in a vertical position from container 1. When using the longer roller the end support 4, FIG. 2 and FIG. 3 is used to support the paint roller. When the shorter roller is used, the two post supports 3, FIG. 2 and FIG. 5, are used to support the paint roller; the recessed support 2, FIG. 2 and FIG. 4, is used to hold the paint roller handle 10, FIG. 1, in the proper position with the paint roller handle 10, FIG. 1, in the upward position. When the user wants to keep the paint roller in the usable condition, for example, overnight to be used the next morning, or during a lunch break, or during interruptions of the painting project, the user places the paint roller 9 into container 1 with wet paint and places the snap-on lid 6, FIG. 1, over the top edge of container 1, then pressing downward with fingers around the top edge of container 1 causing the snap-on lid 6 to pop into a firm position on container 1. The snap-on lid 6 has a raised bead 8, FIG. 7, a molded-in element, which is designed to pop into groove 5, FIG. 7, a molded-in element in container 1. When the user wants to remove the paint roller 9 from the usable storage condition, the user by pressing upwards with the ends of his fingers along the bottom edge of the snap-on lid 6 will cause the snap-on lid 6 to slide upwards out of of the groove 5, a molded-in element in container 1, causing the snap-on lid 6 to completely pop off container 1. With the snap-on lid 6 removed, the user will place his hand on the paint roller handle 10 by pulling upwards, remove the paint roller from the storage container 1. Now the user is ready to place the paint roller into a tray of wet paint and start applying paint to whatever object is to be painted. When the user is done painting, the user can now clean up the paint roller then store the paint roller 9 in the paint roller holder-container to dry with the snap-on lid 6 snapped on the top edge of container 1 for long term storage. When the user wants to store the paint roller for a short term storage, the paint roller need not be cleaned up but place the wet paint roller 9 into container 1, then fill container 1 with wet paint, or water or paint thinner, whichever is applicable. By first placing the wet paint roller in the container 1 before filling container 1 with wet paint, or water, or paint thinner, will prevent the wet paint, water or thinner from running over the top of container 1 when the paint roller is placed into container 1. The snap-on lid 6 is then snapped over the top edge of container 1 with the paint roller handle 10 protruding upward and through slot 7 on the snap-on lid 6. The paint roller is in the ready-to-use storage condition.

While I have described the process of opening, closing and removing or placing the paint roller in paint roller holder-container of the invention in some detail, in practice I have found that it can be used very rapidly and neatly, usually in less than ten seconds. I have made a cardboard model allowing me to actually see how the paint roller holder-container operates.

CONCLUSION AND SCOPE OF INVENTION

While the above description of invention and operation of invention contains many specifities, the reader should not construe these as limitations on the scope of the invention but merely as exemplification of preferred embodiments thereof. Those skilled in the art will envision many other possible variations are within its scope. For example, skilled artisans will readily be able to change the dimensions and shapes of the various embodiments, they will also be able to make the paint roller holder-container of alternative materials, such as different plastics, metals, rubber and wood. They can make many variations of the recessed support 2, FIG. 2 and FIG. 4, of the post support 3, FIG. 2 and FIG. 5, of the end support 4, FIG. 2 and FIG. 3, of the groove 5, FIG. 7, of the snap-on lid 6, FIG. 1 and FIG. 7, of the slot 7, FIG. 6, of the raised bead 8, FIG. 7.

All the above mentioned variations could be round, square, angled, sloped, reversed (opposite in nature). As an alternative, the height, width, length, thickness of walls on side, bottom and top of paint roller holder-container and surface texture all these mentioned variations could be incorporated into my invention; therefore, making these variations not novel or unobvious for those skilled in the art, should they in the future envision these possible variations in a future design of a paint roller holder-container.

Accordingly, the reader is requested to determine the scope of the invention by the appended claims and their legal equivalents, and not by the examples which have been given.

I claim:

1. A combination holder-container for a long or short paint roller having a handle, comprising a rectangular container and a rectangular snap-on lid made of hard, durable material of sufficient size to accommodate and encase such paint roller, the container and the lid each having a first end and a second end, a recessed support located on said first end of the container of sufficient size to support and hold said handle in place in a vertical position, an end support located on said second end of said container and of sufficient size and slope to support and hold said long paint roller up-off the bottom surface of said container, post supports of sufficient number and size with sufficient height and location to hold said short paint roller up-off the bottom surface of said container, said lid having a sufficient size slot on said first end and adapted to be located over the first end of the container to allow said handle to protrude upward through said slot.

2. A combination holder-container according to claim 1 in which the first end, second end and two sides of the lid has a raised bead element of sufficient size engageable with a groove element located in the first end, second end and two sides of said container, whereby downward force on the lid causes it and the container to latch together securely in a closed position.

* * * * *